United States Patent [19]

Roth

[11] Patent Number: 4,642,831

[45] Date of Patent: Feb. 17, 1987

[54] ROLLER BRUSH

[76] Inventor: Eric M. Roth, 153 Lake Drive N, Keswick, Ontario, Canada, L4P 3C8

[21] Appl. No.: 781,048

[22] Filed: Sep. 27, 1985

[51] Int. Cl.[4] ..... A46B 13/08; A46B 15/00

[52] U.S. Cl. ..... 15/1.5 R; 15/4; 15/22 B; 15/41 R; 15/49 R; 15/99

[58] Field of Search ..... 15/22 R, 22 B, 27, 41 R, 15/47, 48, 49 R, 51, 99, 104 A, 160, 4, 1.5 R

[56] References Cited

U.S. PATENT DOCUMENTS

| | | | |
|---|---|---|---|
| 1,431,329 | 10/1922 | Radcliffe | 15/22 B |
| 2,153,686 | 4/1939 | Deegan, Sr. | 15/99 |
| 2,177,298 | 10/1939 | Forsberg | 15/99 |
| 3,252,175 | 5/1966 | Pedersen | 15/22 B |
| 3,686,699 | 8/1972 | Knestele | 15/22 B |

FOREIGN PATENT DOCUMENTS

| | | | |
|---|---|---|---|
| 2060377 | 6/1971 | Fed. Rep. of Germany | 15/22 B |
| 90301 | 9/1937 | Sweden | 15/22 B |

*Primary Examiner*—Edward L. Roberts

[57] ABSTRACT

A brushing implement uses a belt covered with slant fibers on two rollers, having a straight flight between the two rollers which is used for brushing. Yieldable resistance means to belt movement causes the belt to skid on the brushed surface producing the brushing action.

20 Claims, 4 Drawing Figures

ROLLER BRUSH

Figure 1:
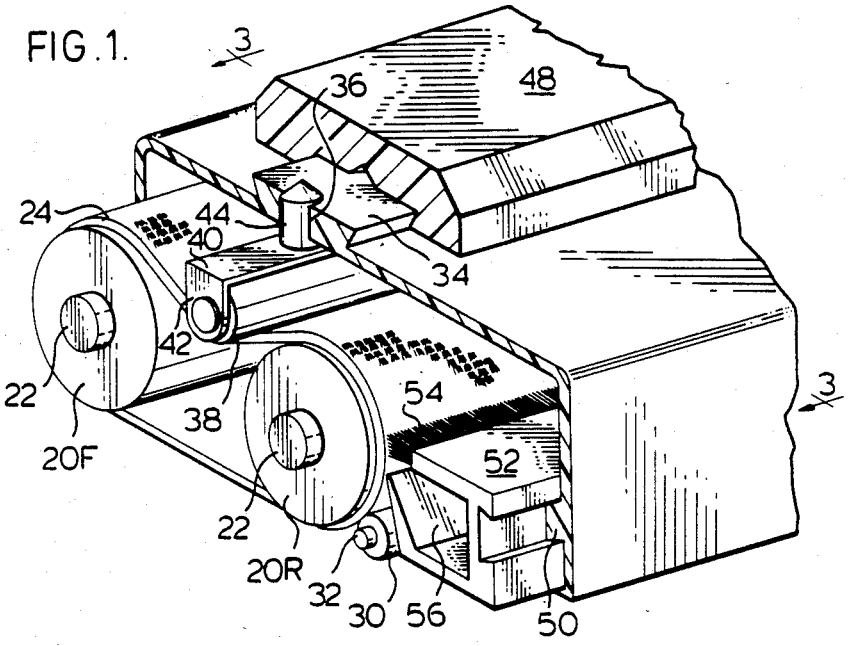

This invention relates to a brushing element or device called herein a roller brush and designed for brushing clothing, fabrics, upholstered furniture and the like to remove small articles therefrom.

Present brushes for accomplishing the above purposes are provided with bristles or slant pile fabrics on fixed bases. Such brushes have the disadvantage therefore that they become dirty or clogged after repeated use, and must be cleaned in a separate operation.

The slant pile fabrics to which reference is made and which are preferred for use with the present invention are commonly made with nylon strings woven through a cotton backing to provide an extent between stitch apertures double the pile length required. These extends are then cut to produce the piles and these are "panned", which is the application of a heated surface to the piles in one sense, to produce the required slant. Inter alia this material may be obtained through Collins & Aikman Corporation, Ca-vel Division, Ca-vel, North Carolina, U.S.A. 27112.

Brushes have been made using such fabric and have the characteristic that the brush is applied along a surface in the slant direction to brush the surface and applied along a receptacle surface in the opposite direction to clean the brush. An example of such brush is that shown in Canadian Patent No. 919,364 to E. M. Roth dated Jan. 23, 1973.

It is an object of the invention to provide a roller brush which is self cleaning. With such a brush, so far as the user is concerned, no separate cleaning action is required and the brushing surface is cleaned during the use of the brush.

It is an object of the invention to provide a brushing element or device which comprises a pair of parallel rollers, mounted on a housing and carrying a belt having an exterior brushing surface thereon. The rollers are mounted in relation to the housing so that the lower belt flight is below the housing so that it may be applied to a fabric surface to brush the latter. Means are provided to maintain tension in such lower flight and to clean the exterior surface of said belt when the latter is within the housing. Means are also provided to yieldably resist movement of said belt which may be by increasing belt tension, by inhibiting the rolling of one of said pair of rollers, or by inhibiting the sliding of said belt through the housing or otherwise. Such movement resisting means are designed to allow some movement of the belt during the brushing action but to prevent the belt always moving freely relative to the housing (which would cause the belt to remain stationary on the surface to be brushed and eliminate brushing action). Thus the resistance to belt movement must be strong enough that there is some 'skid' of the belt on the brushed surface during brushing (producing the brushing action) but allowing some movement of the belt during some conditions of brushing, to produce new belt material on the lower flight for brushing, while allowing cleaning of the belt portion inside the housing.

Thus, during brushing, the pressure used by the user will vary and the resistance to belt movement may be selected so that the belt moves during heavier pressures of brushing and does not move at other times.

Preferably the exterior brushing surface of the belt is the slant-pile material heretofore described, with the slant pile material oriented so the pile fibers slant outwardly from their bases in one longitudinal direction of the belt. Thus the brushes slant outwardly from the belt in one direction on its lower flight which direction is the brushing direction.

In a further preferred form of the invention, the belt is provided with adjustable tensioning means so that the tension of the lower flight may be adjusted This may also be used as the means of yieldable resistance to belt travel since such resistance will increase with increasing tension.

Other features and advantages will be discussed in connection with the preferred embodiment.

Figure 2:
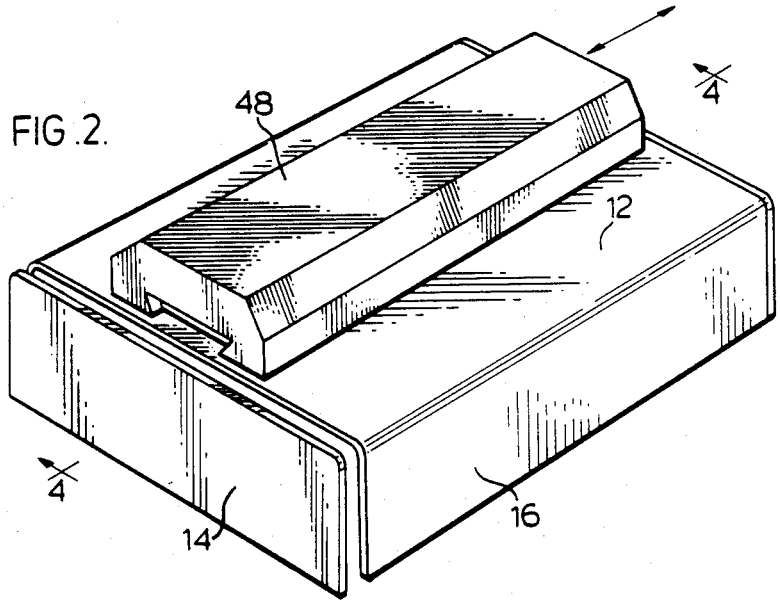
Figure 3:
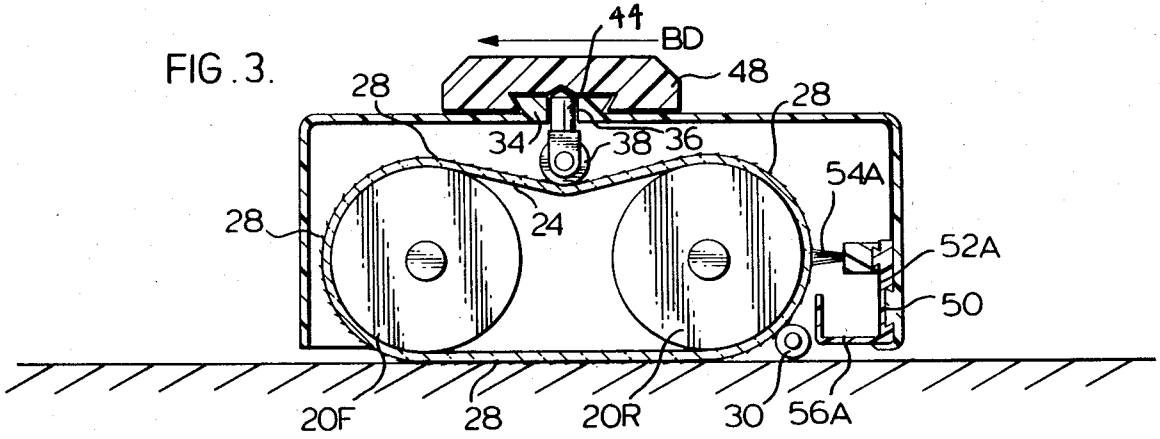
Figure 4:
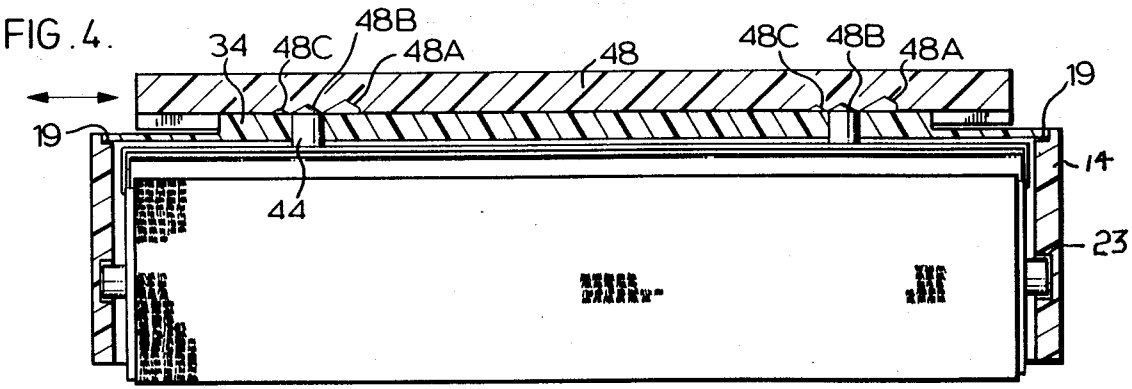

In drawings which illustrate a preferred embodiment of the invention :

FIG. 1 is a cut-away perspective showing the operating elements of the roller brush, FIG. 2 is a perspective of the roller brush from above and outside the housing, FIG. 3 is a vertical section through the device taken along the lines 3—3 of FIG. 1; and FIG. 4 is a vertical section through the device taken along the lines 4—4 of FIG. 2.

In the drawings, a housing 10 defines top wall 12, end walls 16 and side walls 14 and an open bottom.

In the preferred assembly method, the side walls 14 are separately molded and recessed, as shown at 19 at the side wall edge which meets a top or end wall edge, and the joining edges are attached by a suitable adhesive. The recessing at 19 is hidden by the wall 14 in FIG. 2. Alternatively one of the side walls 16 may be molded with the end and side walls as a unit while the other side wall is glued on after the components inside the housing have been installed. Other alternative means of constructing the housing may be made as hereinafter discussed.

A pair of rollers 20F and 20R, the front and rear roller respectively with parallel axes are mounted in the side walls 14 of the housing on pivot stubs 22 rotating in bearing wells 23 in the side walls. The mounting for rollers 20F and 20R is such that the lower peripheries of the rollers are below the housing. A belt 24 runs about the rollers, defining an upper flight and a lower flight. Because of the location of the rollers, it will be noted that with the belt tensioned in its upper flight, the lower flight is located to contact the fabric or other material 26 to be brushed. The outside surface of the belt is of slant pile fibres 28 and the slant of the fibres from the root to the tips is in the longitudinal direction of the belt and in the direction of front roller 20F along the lower flight defining the brushing direction indicated by the arrow BD.

Just rearward of the rear roller 20R is a cylindrical rod 30 of dielectric material having stub shaft ends 32 for mounting in wells (not shown) molded into the side walls 14. By the term 'dielectric' I mean a material which will generate surface static electricity when rubbed. I prefer to use ebonite. The cylinder is rotatably mounted in the housing to contact both the surface of belt 24 and the surface to be brushed and to electrostatically collect small particles from each.

The upper wall of the housing is provided on its top surface with a transverse flat ridge 34, which is preferably of plastic molded integrally with the housing. The side surfaces of the ridge are here bevelled downwardly and toward each other as shown. A pair of laterally disposed vertical bores 36 are provided in the ridge and upper wall near the respective sides of the housing.

A tension roller 38 is supported in a transversely extending bracket 40 with downwardly extending ears 42 transversely extending. The bracket 40 is provided with a pair of upwardly extending studs 44 dimensioned and spaced to make a close sliding fit with respective apertures 36. The upper ends of studs 44 are tapered as shown. A control block 48 is shaped to engage and slide along the bevelled surfaces of ridge 34. The block 48 is provided with three pairs of upwardly facing wells (the pairs being designated 48A,48B and 48C) each pair being spaced to simultaneously overlie the apertures 36. The wells are complementary in shape to the upper ends of studs 44 and depths of the wells pairs are graded so as to produce progressively lower positions of studs 44 and tension roller 42.

The tension roller 38 is mounted in bracket 40 so that its axis is parallel to rollers 20F and 20R and is located approximately mid-way between them. It will be noted that the tension of the belt may be controlled by movement of slide block 48. It should also be noted that the tension control, in addition to providing a flat lower flight for belt 22 also increases (through the belt tension) friction at the three roller bearings. This creates a resistance to movement of the belt on the rollers and provides the result that on forward brushing motion, the belt does not move freely about the rollers and, although moving sometimes, thereabout, also skids at least intermittently on the surface being brushed, producing the brushing action.

The rear wall of the casing is shaped, as shown in FIG. 1 to provide a bevelled transverse slide 50 onto which may be slid the bracket 52 with its cooperating surfaces. The bracket 52 carries forwardly extending brush 54 extending laterally the width at the belt, and designed and shaped to contact the belt across its width during the latter's contact with roller 20R and detach particles therefrom. It will be noted that the belt will be moving upwardly and the fibers of the slant pile belt will be sloping downwardly when they pass the brush 54 so that it will be easy to detach the particles from the belt. The bracket also carries a tray 56 having a forward edge close to the belt and located below the point of contact of brush 54 and belt 24 to receive the particles detached by the brush.

FIG. 3 shows an alternate arrangement for the bracket,tray and brush. In FIG. 3 the bracket 52A is a unitary molding with its tray 56A but brush 54A is part of a separately molded member which is mounted on bracket 52A by a bevelled slide as shown.

The modes of constructing the housing and the contained components are not limited to those shown. The illustrated construction shows adhesively attached side walls 14 one of which is installed after the rollers, belt, tension roller and bracket have been inserted. The same method may be used if the housing is molded with integral side wall and one wall separate which is added after the side walls are installed. The invention includes a housing with two integrally molded side walls although in this event the rollers would have to be installed by having the side walls deflectable outwardly to receive the rollers and by providing an aperture in one side wall to allow insertion and retraction of the bracket 52 or 52A and the cleaning brush.

In use, the roller brush is brushed in direction BD over the fabric or other surface to be cleaned. The tension of the tension roller 38 is adjusted so that such brushing causes some skidding of the belt 24 on the surface but so that during brushing whether intermittently or not, some movement of the belt, with the lower flight moving rearwardly relative to the housing takes place. Such movement brings the belt in its upward travel from the lower flight into contact with the brush 54 or 54A which detaches the particles from the belt to have them fall into the tray 56 or 56A. At the same time, the ebonite rod 30 contacting both brushed surface and belt attracts small particles from both and from time to time may be separately cleaned. With a detachable or apertured side wall, the tray may be emptied from time to time and the brush belt replaced.

If it is desired a separate frictional device may be provided to adjust the resistance of the belt to movement relative to the housing and the tension roller only used to tension the belt. The tension roller may be spring biased. Alternatively an edge or bar may contact the belt to supply the tensioning to replace the tensioning roller.

I claim:

1. Roller brush defining a brushing direction, including a housing, a pair of parallel rollers rotatably mounted in said housing, the periphery of each said roller extending below the bottom of said housing, an endless belt designed to extend about said rollers, thus defining the lower flight of said belt below the bottom of said housing, and an upper flight within said housing, means for tensioning said belt designed to provide that said lower flight is substantially straight between said rollers, said belt being provided with an outwardly facing surface of slanted synthetic fibres said fibres being slanted outwardly in one of the longitudinal directions of said belt, the direction of slant of said fibres from said belt on said lower flight defining the brushing direction, means yieldably resisting movement of said belt over said rollers.

2. Roller brush as claimed in claim 1 wherein said tensioning means comprises a tensioning roller mounted with an axis parallel to said pair of rollers to bear on the upper flight of said belt.

3. Roller brush as claimed in claim 2 wherein means are provided within the housing for removing particles from the outer surface of said belt.

4. Roller brush as claimed in claim 3 including means for storing particles removed by said removing means.

5. Roller brush as claimed in claim 3 wherein said means for removing particles is a brush mounted on said housing arranged to contact said outer belt surface at a location where said belt is in contact with the rearward of said pair of parallel rollers.

6. Roller brush as claimed in claim 2 wherein said tension roller is adjustable to vary the tension of the belt.

7. Roller brush as claimed in claim 2 including a dielectric rod mounted in said housing adapted to contact said belt and the surface to be brushed.

8. Roller brush as claimed in claim 1 wherein means are provided within the housing for removing particles from the outer surface of said belt.

9. Roller brush as claimed in claim 8 including means for storing particles removed by said removing means.

10. Roller brush as claimed in claim 8 wherein said means for removing particles is a brush mounted on said housing arranged to contact said outer belt surface at a location where said belt is in contact with the rearward of said pair of parallel rollers.

11. Roller brush as claimed in claim 10 wherein said tension roller is adjustable to vary the tension of the belt.

12. Brushing implement as claimed in claim 1 including a dielectric rod mounted in said housing adapted to contact said belt and the surface to be brushed.

13. Roller brush including a housing, a pair of parallel rollers rotatably mounted in said housing, the periphery of each said roller extending below the bottom of said housing, an endless belt designed to extend about said rollers, thus defining a lower flight of said belt, below the bottom of said housing, and an upper flight within said housing, means for tensioning said belt designed to provide that said lower flight is substantially straight between said rollers, said belt being provided with an outwardly facing surface designed to perform a brushing action on a fabric, said belt and rollers being designed to be driven relative to said housing by manual pressure exerted on said housing causing pressure of said belt against a surface to be cleaned while moving said housing and belt in a longitudinal direction of said lower flight, means yieldably resisting movement of said belt over said rollers.

14. Roller brush as claimed in claim 13 wherein said tensioning means comprises a tensioning roller mounted with an axis parallel to said pair of rollers to bear on the upper flight of said belt.

15. Roller brush as claimed in claim 14 wherein said tension roller is adjustable to vary the tension of said belt.

16. Roller brush as claimed in claim 13 wherein means are provided within the housing for removing particles from the outer surface of said belt.

17. Roller brush as claimed in claim 16 wherein means are provided for storing particles removed by said removing means.

18. Roller brush as claimed in claim 17 wherein said tension roller is adjustable to vary the tension of said belt.

19. Roller brush as claimed in claim 16 wherein said tension roller is adjustable to vary the tension of said belt.

20. Roller brush as claimed in claim 13 including a dielectric rod mounted in said housing adapted to contact said belt and the surface to be brushed.

* * * * *